United States Patent [19]

Carlton

[11] 4,291,477

[45] Sep. 29, 1981

[54] GUN BARREL CLEANING DEVICE

[76] Inventor: Guy L. Carlton, 1294 Bellaire Ct., Naples, Fla. 33940

[21] Appl. No.: 36,357

[22] Filed: May 7, 1979

[51] Int. Cl.[3] ..... F41C 31/00

[52] U.S. Cl. ..... 42/1 BC; 15/104.19

[58] Field of Search ..... 42/90, 1 R, 1 BC; 15/104.16, 104.165, 104.17, 104.18, 104.19

[56] References Cited

U.S. PATENT DOCUMENTS

| | | | |
|---|---|---|---|
| 355,570 | 1/1887 | Smith | 15/104.165 |
| 460,986 | 10/1891 | Odell et al. | 15/104.18 |
| 486,331 | 11/1892 | Garrison | 15/104.19 |
| 566,041 | 8/1896 | Warner | 15/104.19 |
| 921,569 | 5/1909 | Tupes et al. | 15/104.16 |
| 2,616,109 | 11/1952 | Gardner | 15/104.165 |
| 2,763,081 | 9/1956 | Huckabee | 42/90 |
| 3,064,294 | 11/1962 | Stocking | 15/104.19 |
| 3,205,518 | 9/1965 | Romaine | 15/104.165 |

*Primary Examiner*—Charles T. Jordan
*Attorney, Agent, or Firm*—Arthur W. Fisher, III

[57] ABSTRACT

A gun barrel cleaning device for use with a cleaning rod comprising a hollow annular compression member having an internally threaded coupling insert affixed to one end thereof, an externally threaded coupling member at least partially disposed within the hollow annular compression sleeve including an enlarged threaded portion operatively engaged with the internally threaded coupling insert having a first and second attachment element formed on opposite ends thereof, the first attachment element comprising a reduced externally threaded portion to affix the gun barrel cleaning device to a cleaning rod and the second attachment element comprising an aperture to affix a retaining member configured to retain a spongeous cleaning element to the gun barrel cleaning device wherein the externally threaded member and retaining member are adjustable longitudinally relative to the hollow annular compression sleeve to selectively compress the spongeous cleaning element between one end of the hollow annular compression sleeve and the retaining member.

7 Claims, 2 Drawing Figures

FIG. 1
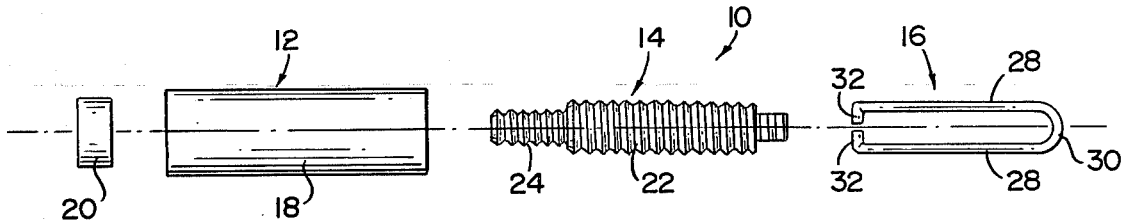
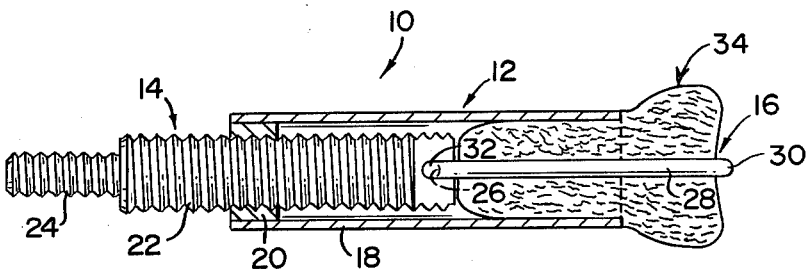
FIG. 2

GUN BARREL CLEANING DEVICE

BACKGROUND OF THE INVENTION

1. Field of the Invention

A gun Barrel Cleaner for use with a cleaning rod and swab.

2. Description of the Prior Art

There are usually several stages of cleaning a muzzle-loading black powder gun, either when the shooter is hunting or the final cleaning after a day on the range. The buildup of residue after even one shot effectively reduces the interior bore diameter of the barrel causing subsequent powder pressures to increase. Thus, if the first ball or bullet leaves the muzzle at, for example 1200 feet per second, the next shot will leave at approximately 1400 feet per second. Obviously accuracy will be lost as bullets fired from a given point at different speeds will not strike at the same point of impact. To combat this, muzzle loading competitors and experts wipe the barrel after each shot (with the exception of the first, non-scoring, "fouling" shot permitted in matches to blow away and burn out excess oil or other preservatives left in the barrel for protection while not in use) to assure that bore diameter is the same for each shot. If this is not done, after as few as five shots in a fine rifle, it will be impossible to drive the ball down the barrel completely without badly deforming the soft lead creating a dangerous condition in which the barrel may burst if the piece is fired with any appreciable space between the powder charge and the ball lodged in the barrel.

Another phase or stage in the cleaning of black powder firing guns is one of extreme importance for the preservation of the gun or pistol or revolver in good condition. Both black powder and the newly developed substitute known by the trade name of "pyrodex" are hygroscopic of an extraordinary degree. It is of utmost importance that no residue of these substances be permitted to remain in the bore during storage or non-use due to the fact that they attract ambient humidity and will pit gun barrel steel, ruining the bore of the gun. The most common method of cleaning a muzzle loader during this final phase is to remove the percussion cap nipple with a wrench specially built for that purpose, remove the barrel from the lock and stock assembly and immerse the breech into a container of several gallons of hot plain or detergent-laden water. At this point, the shooter attempts to creater a "pumping" action by pushing a patch down the barrel on a "jag" and drawing it slowly back from the breech block to the muzzle, pulling water or cleaning solution along with it in a reverse-piston action so that the soapy solution is drawn throughout the bore length. With a "jag" and a patch, this operation must be repeated as many as twenty times. The patch must be changed each time until the last patches come through clean. During this operation patches are commonly "lost" in the bore.

As a result, a number of devices have developed to overcome these shortcomings or difficulties. Examples of these efforts are shown in U.S. Pat. Nos. 355,570; 1,156,683; 2,447,869; 2,744,275; 2,616,109; 2,763,081; 2,856,738; 3,205,518 and 4,050,175.

Despite these efforts a need for an effective reliable cleaning device exists.

SUMMARY OF THE INVENTION

The present invention relates to a gun barrel cleaning device used with a cleaning rod. More specifically, the gun barrel cleaning device comprises a compression sleeve, coupling member and retaining member.

The compression sleeve comprises a hollow annular compression member having an internally threaded coupling insert affixed to one end thereof. The coupling member comprises an externally threaded body at least partially disposed within the hollow annular compression member including an enlarged threaded portion disposed to operatively engage with the internally threaded coupling insert. A first attachment element and a second attachment element are formed at opposite ends of the enlarged threaded portion. The first attachment element is configured to attach the gun barrel cleaning device to a cleaning rod while the second attachment element is configured to affix the retaining member to the coupling member. The retaining member comprises a pair of substantially parallel retaining elements. In use, a spongeous cleaning swab or element is retained securely within the retaining member.

The adjustment of the coupling member permits a unique compression of a spongeous cleaning swab held by the retaining member by the adjustable position of the compressive sleeve by movement of the retaining member longitudinally relative to the compression sleeve. This permits the device to accept and adjust by the degree of compression the diameter and therefore degree of tighness of barrel fit of the spongeous cleaning swab permitting it to be used as a very effective cleaning device for firearms, especially those muzzle loading, black powder firing arms between calibers 0.36" and 0.90".

The sponge maerial, being far more porous and absorbant than normal cotton or muslin patching, carries much greater amounts of solvent or cleaning liquid throughout the length of the barrel, resulting in far more efficient distribution of the liquid cleaning material. Moreover because of the resiliant tendancy or "memory" of spongeous materials to spring back to their original conformations, the material presses itself into the spaces between the lands and grooves of a rifled barrel far better than other cloth materials usually utilized by merely being pushed through the bore by a blunt ramrod attachment usually called a "jag". This provides better contact between the bore and therefore, better cleaning action than cloth.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is an exploded side view of the gun barrel cleaning device.

FIG. 2 is a cross-sectional side view of the gun barrel cleaning device.

Similar reference characters refer to similar parts throughout the several views of the drawings.

DETAILED DESCRIPTION OF THE PREFERRED EMBODIMENT

As shown in FIGS. 1 and 2, the gun barrel cleaning device 10 of the present invention comprises a compression sleeve, coupling member and retaining member generally indicated as 12, 14 and 16 respectively.

The compression sleeve 12 comprises a hollow annular compression member 18 having an internally threaded coupling insert 20 affixed to one end thereof. The coupling member 14 comprises an externally threaded body at least partially disposed within the hollow annular compression member 18. The externally threaded body 14 includes an enlarged threaded portion 22 disposed to operatively engage with the internally threaded coupling insert 20. A first attachment element comprising a reduced externally threaded portion 24 and a second attachment element comprising an aperture 26 are formed at opposite ends of the enlarged threaded portion 22. The first attachment element 24 is configured to attach the gun barrel cleaning device 10 to a cleaning rod (not shown) while the second attachament element 26 is configured to affix the retaining member 16 to the coupling member 14 as more fully described hereinafter. Specifically the retaining member 16 comprises a pair of substantially parallel retaining elements each indicated as 28 attached together by a substantially U-shaped interconnecting element or end portion 30. A pair of retaining tips 32 extend inwardly and at substantially right angles from the inner ends of the substantially parallel retaining elements 28. The entire retaining member 16 is constructed from a flexible material such that the pair of retainin tips 32 seat within aperture 26 when the gun barrel cleaning device 10 is assembled. In use a spongeous cleaning swab or element 34 is retained securely within the retaining member 16. Moreover, the adjustment of the coupling member 14 permits a unique compression of spongeous cleaning swab 34 held by the retaining member 16 by the adjustable position of the compression sleeve 12 by movement of the retaining member 16 longitudinally relative to the compression sleeve 12. This permits the device 10 to accept and adjust by the degree of compression the diameter and therefore degree of tightness of barrel fit of the spongeous cleaning swab 34 permitting it to be used as a very effective cleaning device for firearms, especially those muzzle loading, black powder firing arms between calibers 0.36" and 0.90". The device 10 utilizes spongeous cleaning swabs 34 rather than the standard cotton patching which has several major advantages in removing the residue of nitro-based powders (black) from gun barrels, especially those with fixed breech blocks.

The sponge material, being far more porous and absorbant than normal cotton or muslin patching, carries much greater amounts of solvent or cleaning liquid throughout the length of the barrel, resulting in far more efficient distribution of the liquid cleaning material. Moreover, because of the resilient tendency of spongeous materials to spring back to their original conformations, the material presses itself into the spaces between the lands and grooves of a rifled barrel far better than other cloth materials usually utilized by merely being pushed through the bore by a blunt ramrod attachment usually called a "jag". This provides better contact between the bore and therefore, better cleaning action than cloth.

Because of the compression of the spongeous cleaning swab 34 between the retaining member 14 and the compression sleeve 12 the swab 34 is flared ahead of the tip of the retaining member 14 as well as in a skirt-like manner to the sides. The compression of the axis of the swab 34 permits complete contact of the cleaning material with the face of the closed breech block, such face being impossible to scour with the standard cotton patch and "jag".

When cleaning muzzle loading firearms with a standard patch and "jag" the patch is frequently "lost" in the bore because of poor contact with either the bore surface, the "jag", or both. This necessitates the shooter to remove the "jag", screw into place a corkscrew-like device called a "patchpuller" to snag and retrieve the detached patch. With the spongeous cleaning swab 34 held in a firm grip between the retaining member 14 and the compression sleeve 12, the swab 34 cannot come free from the grip in which it is held saving time and inconvenience.

The very nature of this gun barrel cleaning device 10 lends itself to a very wide selection of spongeous materials of different textures and degrees of absorbancy and abrasion to remove stubborn residue or even rust. The advent of the new sponge materials featuring high abrasion scouring surfaces makes this feature especially important to the shooter. A wide diversity of sponge types may be employed during the cleaning operation, which may include abrading the raw residue, to finer cleaning of light residue to final oiling to protect the bore from rust or pitting while not in use.

Without question, the above observations on the advantageous properties of spongeous material in use with a device of the unique qualities of the device 10 will be of great value to the shooter of antique and reproduction muzzle loading black powder firearms. Despite its singular concept of cleaning material usage, the device 10 is of immeasurable further value as it is completely adjustable in terms of the diameter of bore with equal facility, dependant upon the size of the pre-cut piece of spongeous material 34 utilized and how tightly it is compressed between the retaining member 16 and the compression sleeve 12. The effect of this adjustability is that the purchase of a single device 10 eliminates the need for a separate cleaning "jag" for each different caliber gun or pistol the shooter owns. It is limited only by the diameter of the compression sleeve 12 itself and serves every caliber commonly utilized in muzzle loading rifles, smootherbores, revolvers and pistols from 0.36" up to the largest calibers commercially offered, approximately 0.90". Therefore, despite the many other features and advantages already described, the adjustable feature alone declares the device 10 a great advance in the ancient problem of cleaning and maintaining muzzle loading guns.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, I claim:

1. A gun barrel cleaning device for use with a cleaning rod comprising a compression sleeve having a coupling insert formed in one end thereof, a coupling member at least partially disposed within said compression sleeve to operatively engage said coupling insert, said coupling insert comprises an internally threaded coupling insert and said coupling member comprises an enlarged externally threaded portion to operatively engage said internally threaded coupling insert, said coupling member having a first and second attachment element formed on opposite ends thereof, said first attachment element to affix the gun barrel cleaning device to a cleaning rod and said second attachment element to affix a retaining member to retain a spongeous cleaning element to said gun barrel cleaning device wherein said coupling member and said retaining member are adjustable longitudinally relative to said compression sleeve to selectively compress the spongeous cleaning element between one end of said compression sleeve and said retaining member.

2. The gun barrel cleaning device of claim 1 wherein said compression sleeve comprises a hollow annular sleeve.

3. The gun barrel cleaning device of claim 1 wherein said first attachment means comprises a reduced threaded portion extending from said enlarged threaded portion.

4. The gun barrel cleaning device of claim 3 wherein said second attachment element comprises an aperture to engage said retaining member.

5. The gun barrel cleaning device of claim 4 wherein said retaining member comprises a pair of spaced apart parallel retaining elements to retain the spongeous cleaning element therebetween.

6. The gun barrel cleaning device of claim 5 wherein the outer portion of said parallel retaining elements are coupled by a substantially U-shaped interconnecting element.

7. The gun barrel cleaning device of claim 6 wherein said retaining member further includes a pair of retaining tips extending inwardly from said substantially parallel retaining elements to operatively engage said aperture.

* * * * *